US006047147A

United States Patent [19]

Kato et al.

[11] Patent Number: 6,047,147

[45] Date of Patent: Apr. 4, 2000

[54] ELECTROSTATIC IMAGE FORMING APPARATUS

[75] Inventors: Koji Kato; Masayasu Anzai; Hisayoshi Kato, all of Ibaraki, Japan

[73] Assignee: Hitachi Koki Co., Ltd., Tokyo, Japan

[21] Appl. No.: 09/310,990

[22] Filed: May 13, 1999

[30] Foreign Application Priority Data

May 29, 1998 [JP] Japan ..... 10-149663

[51] Int. Cl.[7] ..... G03G 15/06; G03G 15/08

[52] U.S. Cl. ..... 399/55; 399/53

[58] Field of Search ..... 399/48, 50, 51, 399/52, 53, 55, 56, 168, 170, 223

[56] References Cited

U.S. PATENT DOCUMENTS 4,078,929 3/1978 Gundlach ..... 96/1.2
5,659,841 8/1997 Umeda et al. ..... 399/55
5,740,504 4/1998 Akinaga et al. ..... 399/171
5,869,214 2/1999 Anzai et al. ..... 430/47

FOREIGN PATENT DOCUMENTS 48-37148 6/1973 Japan .

*Primary Examiner*—William Royer
*Assistant Examiner*—Hoang Ngo
*Attorney, Agent, or Firm*—Sughrue, Mion, Zinn Macpeak & Seas, PLLC

[57] ABSTRACT

In an image forming apparatus, the absolute value (|VBH−VM|) of the potential difference between a first development bias electric potential (VBH) and an intermediate electric potential (VM) is set to be smaller (|VBH−VM|<|VBL−VM|) than the absolute value (|VBL−VM|) of the potential difference between a second development bias electric potential (VBL) and the intermediate electric potential (VM).

3 Claims, 3 Drawing Sheets

ELECTROSTATIC IMAGE FORMING APPARATUS

BACKGROUND OF THE INVENTION

1. Field of the Invention

The present invention relates to an image forming apparatus for forming an electrostatic latent image on a photoreceptor by a combination of a high electric potential, an intermediate electric potential and a low electric potential and making both an electrostatic latent image portion of the high electric potential and an electrostatic latent image portion of the low electric potential visible to thereby form an image.

2. Description of the Related Art

An image forming apparatus for forming an electrostatic latent image on a photoreceptor by a combination of a high electric potential, an intermediate electric potential and a low electric potential and making both an electrostatic latent image portion of the high electric potential and an electrostatic latent image portion of the low electric potential visible to thereby form an image is well known by JPA-48-37148, U.S. Pat. No. 4078929, etc.

In such an image forming apparatus, a potential pattern of an electrostatic latent image is often explained as a rectangular pattern on the basis of a high electric potential (VH), an intermediate electric potential (VM) and a low electric potential (VL) and lines for connection thereof as represented by the solid line in FIG. 5. However, the light intensity of a laser beam used for recording such an electrostatic latent image has a Gaussian distribution, so that an actual electrostatic latent image is recorded in the form of a curved potential pattern as represented by the broken line in FIG. 5. In the electrostatic latent image of the potential pattern represented by a broken line, when development is performed in the condition that a contrast potential between the high electric potential (VH) and a development bias (VBH) is set to be equal or substantially equal to a contrast potential between a development bias (VBL) and the low electric potential, the line width (L1) of an image obtained by normal development in an electrostatic latent image portion containing the high electric potential (VH) and the line width (L2) of an image obtained by reversal development in an electrostatic latent image portion containing the low electric potential (VL) are different from each other by a value in a range of from about 50 $\mu$m to about 60 $\mu$m though the difference varies in accordance with a beam diameter. There was therefore a tendency that the quality of an image by normal development was so weak with a narrow line width while the quality of an image by reversal development was so dull with a widened line width.

SUMMARY OF THE INVENTION

The present invention has been made to solve the above problem with the conventional apparatus, and therefore an object of the present invention is to provide an image forming apparatus in which there is no variation between the line width of an image formed in an electrostatic latent image portion of a high electric potential and the line width of an image formed in an electrostatic latent image portion of a low electric potential, so that good-quality image formation can be achieved.

The foregoing object is achieved by an image forming apparatus comprising: a latent image forming means for forming an electrostatic latent image on a photoreceptor by a combination of a high electric potential, an intermediate electric potential and a low electric potential; a first developing means which uses a first development bias electric potential provided between the high and intermediate electric potentials for developing an electrostatic latent image portion of the high electric potential by normal development; and a second developing means which uses a second development bias electric potential provided between the intermediate and low electric potentials for developing an electrostatic latent image portion of the low electric potential by reversal development; characterized in that the absolute value of a potential difference between the first development bias electric potential and the intermediate electric potential is set to be smaller than the absolute value of a potential difference between the second development bias electric potential and the intermediate electric potential.

DETAILED DESCRIPTION OF THE PREFERRED EMBODIMENTS

An embodiment of the present invention will be described in detail below with reference to the drawings.

Figure 1:
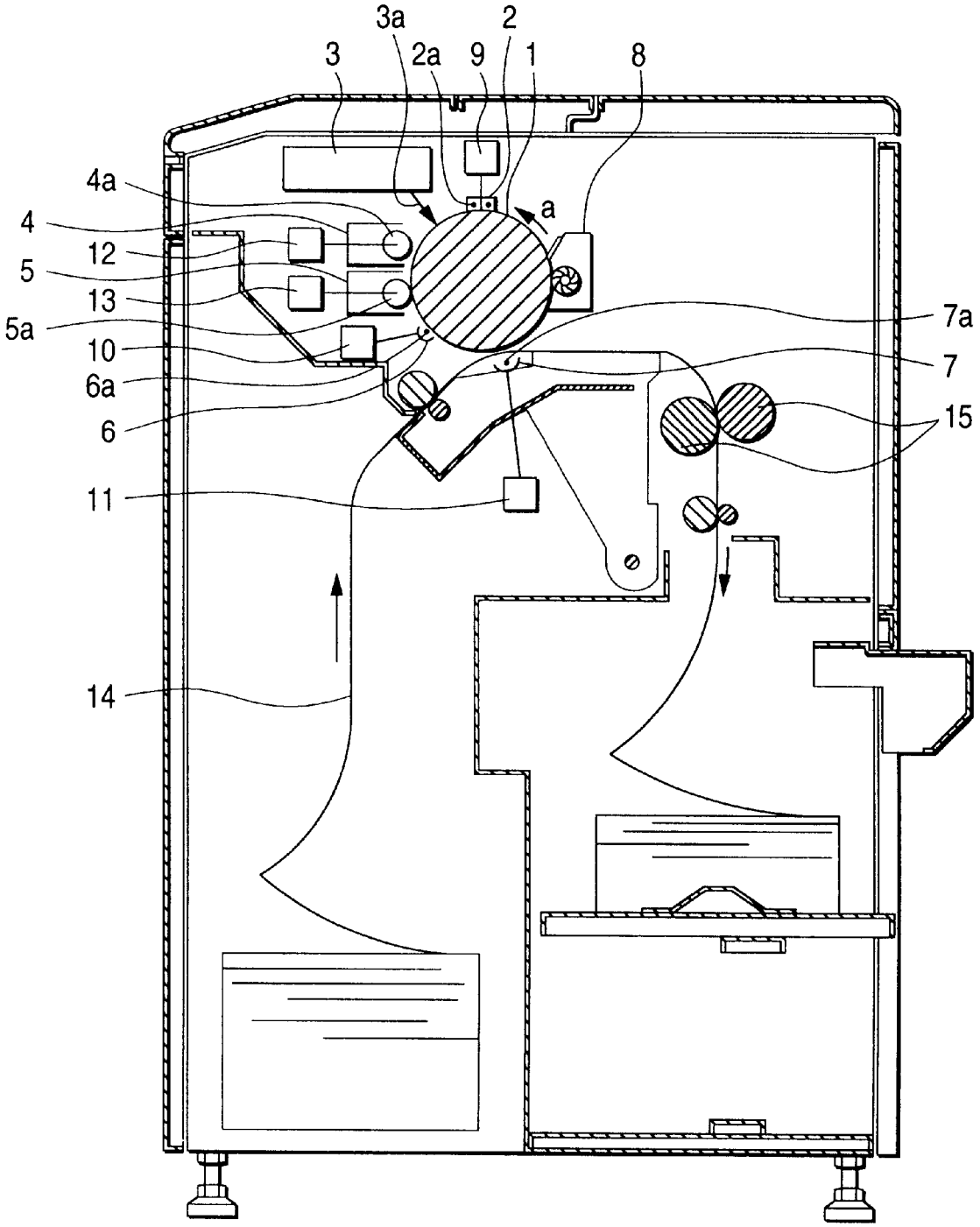
FIG. 1 is a schematic configuration view showing an embodiment of the image forming apparatus according to the present invention.

Referring first to FIG. 1, the configuration of an image forming apparatus according to the present invention will be described.

In FIG. 1, the reference numeral 1 designates a photoreceptor drum. The photoreceptor drum 1 is pivotally supported so as to be rotatable at a constant speed in a direction represented by the arrow a. An electrifier 2, an exposure scanner 3, a first developer 4, a second developer 5, a pre-transfer electrifier 6, a transfer device 7 and a cleaner 8 are disposed around the photoreceptor drum 1. The reference numeral 9 designates an electrifier high-voltage electric source which is an electric source for applying a high voltage to a corona wire 2*a* provided in the electrifier 2 to thereby generate corona discharge. The reference numeral 10 designates a pre-transfer electrifier high-voltage electric source which is an electric source for applying a high voltage to a corona wire 6*a* provided in the pre-transfer electrifier 6 to thereby generate corona discharge. The reference numeral 11 designates a transfer-device high-voltage electric source which is an electric source for applying a high voltage to a corona wire 7*a* provided in the transfer device 7 to thereby generate corona discharge. The reference numeral 12 designates a development bias voltage high-voltage electric source which is an electric source for applying a development bias voltage to a development roller 4*a* provided in the first developer 4. The reference numeral 13 also designates a development bias voltage high-voltage electric source which is an electric source for applying a development bias voltage to a development roller 5*a* provided in the second developer 5. Further, the reference numeral 14 designates a recording material represented by paper. Although FIG. 1 exemplifies an image forming apparatus using a long-scale continuous recording material as the recording material, the present invention is not limited thereto but may be applied to an image forming apparatus using sheet-form paper cut into a size such as A4-size, B4-size, A3-size, etc. in advance.

The image forming operation of the image forming apparatus configured as described above will be described below.

When the photoreceptor drum 1 begins to rotate in the direction of the arrow a, the surface of the photoreceptor drum 1 opposite to the electrifier 2 is electrostatically evenly charged to a high electric potential (VH) by the electrifier 2. The photoreceptor region electrostatically charged to a high electric potential (VH) is exposed by a laser beam 3*a* emitted from the exposure scanner 3, so that an electrostatic latent image is recorded. As described above, in this case, the electrostatic latent image is formed by a combination of a high electric potential (VH), an intermediate electric potential (VM) and a low electric potential (VL). In the electrostatic latent image, an electrostatic latent image portion of the high electric potential (VH) is obtained without substantially suffering radiation of the laser beam 3*a* and has an electric potential equal to the electric potential at the time of charged state. Further, an electrostatic latent image portion of the intermediate electric potential (VM) is formed by suffering radiation of the laser beam 3*a* having a quantity of laser light set to be equal to a half-value exposure quantity of the photoreceptor. Further, an electrostatic latent image portion of the low electric potential (VL) is formed by suffering radiation of the laser beam 3*a* having a quantity of laser light set to be equal to a value in a range of from three times to four times as large as the half-value exposure quantity of the photoreceptor.

When the aforementioned electrostatic latent image reaches a position opposite to the first developer 4, the development bias voltage (VBH) applied to the development roller 4*a* acts on an electrostatic latent image portion of the electrostatic latent image having a high electric potential (VH). As a result, a known and so-called normal-development phenomenon is generated by the function of electric field between the high electric potential (VH) and the development bias voltage (VBH). Accordingly, electrostatically positively charged toner having polarity reversed to that of the photoreceptor deposits on the electrostatic latent image portion of the high electric potential (VH), so that a first image, for example, with red toner, is formed on the photoreceptor drum 1.

When the photoreceptor region having both the electrostatic latent image and the first image held therein then reaches a position opposite to the second developer 5, the development bias voltage (VBL) applied to the development roller 5*a* acts on an electrostatic latent image portion of the electrostatic latent image having a low electric potential (VL). As a result, a known and so-called reversal-development phenomenon is generated by the function of electric field between the low electric potential (VL) and the development bias voltage (VBL). Accordingly, electrostatically negatively charged toner having polarity equal to that of the photoreceptor deposits on the electrostatic latent image portion of the low electric potential (VL), so that a second image, for example, with black toner, is formed on the photoreceptor drum 1.

The first and second images formed on the photoreceptor drum 1 are formed from two kinds of toner different in electrification polarity. Accordingly, before the images are transferred to the recording material 14, the pre-transfer electrifier 6 gives an electric charge to toner to thereby make the polarity of the first image equal to the polarity of the second image. When each of the images having equalized polarities reaches a position opposite to the transfer device 7, the image is transferred from the photoreceptor drum 1 to the recording material 14 by the function of the transfer device 7 which gives an electric charge of polarity reversed to that of toner from the back of the recording material 14.

Not-yet-transferred toner remaining on the photoreceptor drum 1 after passing through the transfer device 7 is removed from the surface of the photoreceptor drum 1 by the cleaner 8 after that. The aforementioned process is repeated so that two-color image recording is performed continuously. On the other hand, the recording material 14 having the first and second images held therein is carried by a heat roller fixer 15 composed of a heat roller and a pressure roller. At the same time, the two kinds of toner which form the first and second images respectively are fixed on the recording material 14 by the heating and pressing function of the fixer 15.

The relation between the electric potential allocation of the electrostatic latent image as characteristic of the present invention and the development bias voltage applied to each developer will be described below on the basis of some specific embodiments.

(Embodiment 1)

Figure 2:
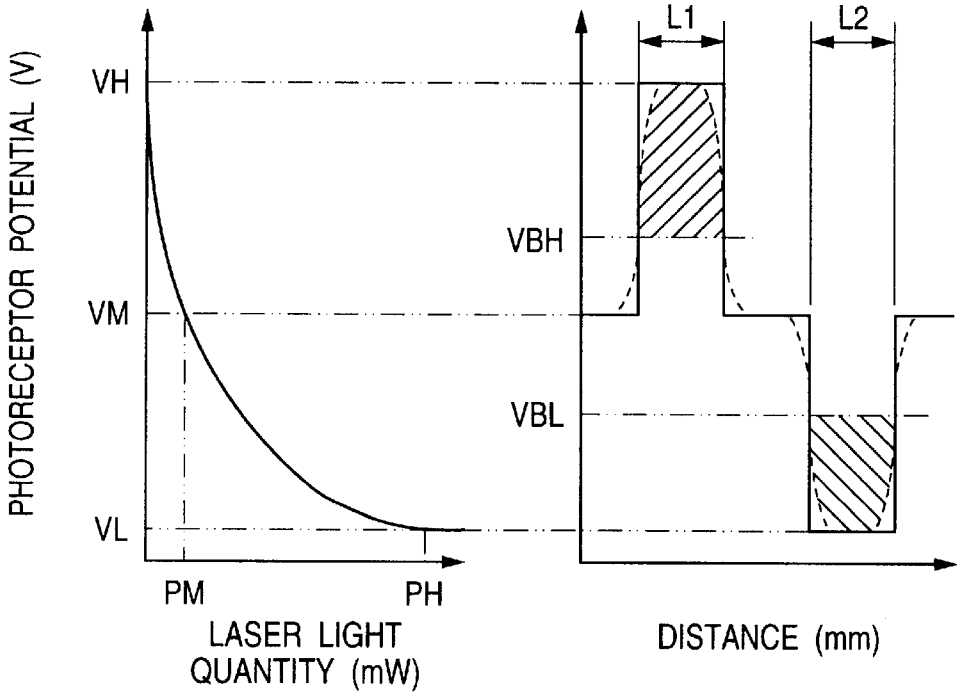
FIG. 2 is a potential distribution graph showing a first embodiment of the present invention.
Figure 5:
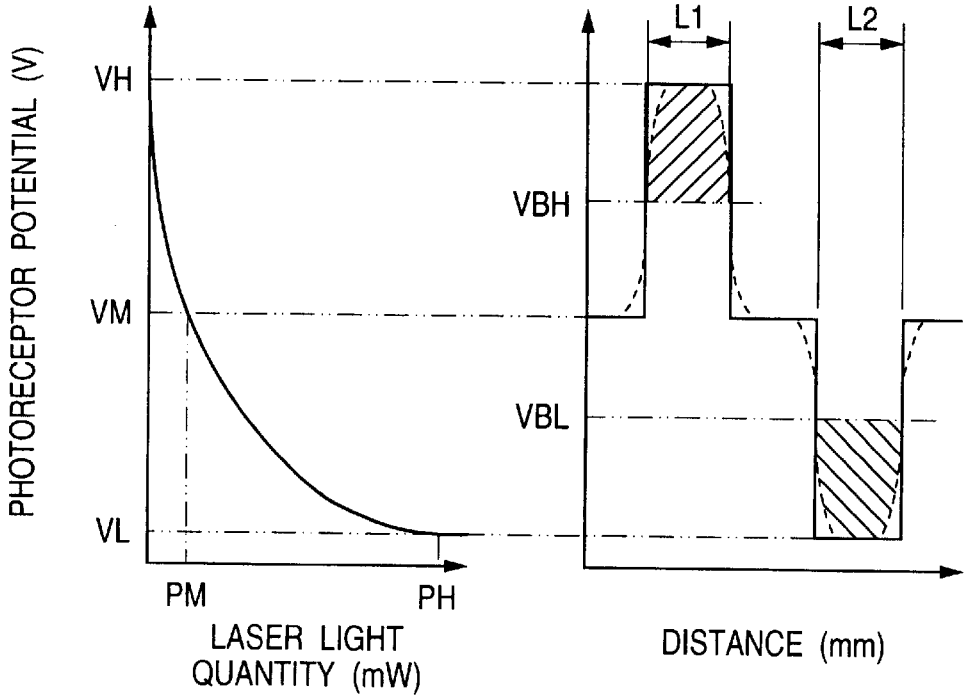
FIG. 5 is a potential distribution graph showing the background art.

As described above, in the electric potential allocation shown in FIG. 5, a difference in a range of from 50 $\mu$m to 60 $\mu$m is produced between the line width of the first image and the line width of the second image, so that a good quality image cannot be obtained. In the present invention, therefore, as shown in FIG. 2, the condition for the second image is set to be equal to the condition shown in FIG. 5 but the development bias electric potential (VBH) for the first image is set to be lower than the potential shown in FIG. 5 so that the line width (L1) of the first image is made equal to the line width (L2) of the second image. As a result, the line width (L1) of the first image and the line width (L2) of the second image are set to be substantially equal to each other.

(Embodiment 2)

Figure 3:
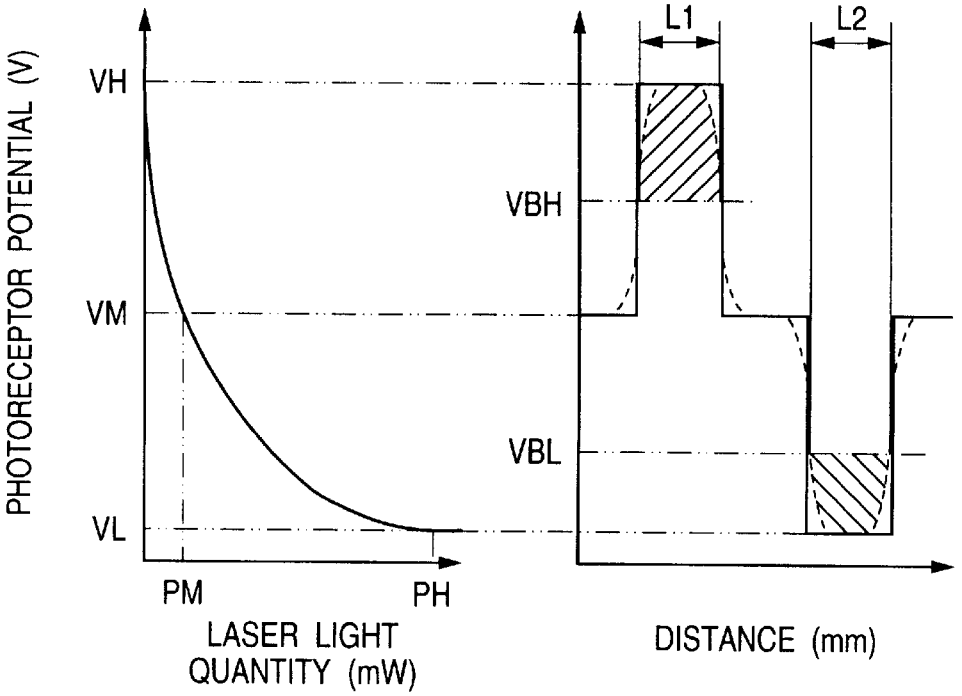
FIG. 3 is a potential distribution graph showing a second embodiment of the present invention.

Further, in FIG. 3, the condition for the first image is set to be equal to the condition shown in FIG. 5 but the development bias electric potential (VBL) for the second image is set to be lower than the potential shown in FIG. 5 so that the line width (L2) of the second image is made equal to the line width (L1) of the first image. As a result, the line width (L1) of the first image and the line width (L2) of the second image are set to be substantially equal to each other.

(Embodiment 3)

In the case where configuration is made such that the photoreceptor can be electrostatically charged to thousands of volts by the electrifier 2 so that a sufficient contrast potential can be obtained, it is thought of that the aforementioned configuration shown in FIG. 3 is employed. In the case where the electrification potential is to be suppressed to hundreds of volts in terms of product specifications such as consumed electric power, etc., the relation with development contrast potential must be taken into account in addition to the problem of line width.

Figure 4:
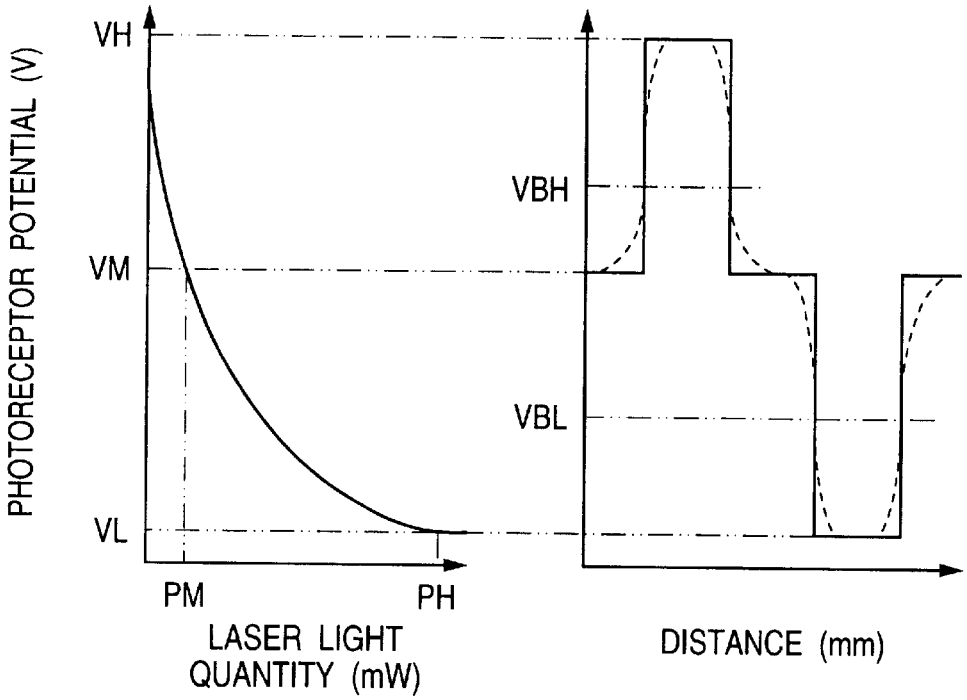
FIG. 4 is a potential distribution graph showing a third embodiment of the present invention.

That is, when the potential difference |VM−VBL| between the intermediate electric potential (VM) and the development bias electric potential (VBL) is set to be large in order to solve the problem of line width, the contrast potential |VBL−VL| for development becomes so small that predetermined printing density cannot be secured. Accordingly, when such a disadvantage occurs, the potential difference |VM−VL| between the intermediate electric potential (VM)

and the low electric potential (VL) is set to be larger (|VH−VM|<|VM−VL|) than the potential difference |VH−VM| between the high electric potential (VH) and the intermediate electric potential (VM) in advance in order to secure the development contrast potential |VBL−VL| for the second image as shown in FIG. 4. As a result, evenness of line width can be achieved while the printing density for the second image is secured.

Incidentally, in FIG. 4, the high electric potential (VH), the intermediate electric potential (VM), the low electric potential (VL), the development bias electric potential (VBH) for the first image and the development bias electric potential (VBL) for the second image are set to be about −900 V, about −500 V, about −50 V, about −650 V and about −250 V respectively. When image formation was performed on the basis of this potential allocation, a good image having no difference between the line width of the first image and the line width of the second image could be obtained.

Incidentally, printing density depends largely on developing agent resistance. It is generally known that the printing density increases as the developing agent resistance decreases. Further, the toner resistance of black toner is lower than that of color toner such as red toner, blue toner, or the like, because black toner contains electrically conductive carbon. Accordingly, when, for example, a two-component developing agent composed of an electrically conductive magnetic carrier and a toner is used as the developing agent, the developing agent resistance of a black developing agent can become lower than that of a color developing agent even in the case where the same carrier is used both in the first developer 4 and in the second developer 5. That is, in the black developing agent, low electric potential development can be made. Accordingly, when black toner is used for recording the second image by a reversal development method requiring low electric potential development and color toner is used for recording the first image by a normal development method easy to secure development potential, printing density can be secured more easily.

As described above, according to the present invention, it is possible to provide an image forming apparatus in which no variation is generated between the line width of an image formed in an electrostatic latent image portion of a high electric potential and the line width of an image formed in an electrostatic latent image portion of a low electric potential, so that the formation of a good-quality image can be achieved.

What is claimed is:

1. An electrostatic image forming apparatus comprising:

a latent image forming means for forming an electrostatic latent image on a photoreceptor by a combination of a high electric potential, and intermediate electric potential and a low electric potential;

a first developing means which uses a first development bias electric potential provided between the high and intermediate electric potentials for developing an electrostatic latent image portion of the high electric potential with a first developing agent by normal development; and a second developing means which uses a second development bias electric potential provided between said intermediate and low electric potentials for developing an electrostatic latent image portion of said low electric potential with a second developing agent by reversal development;

wherein the absolute value of a potential difference between the first development bias electric potential and the intermediate electric potential is set to be smaller than the absolute value of a potential difference between the second development bias electric potential and the intermediate electric potential; and wherein said first developing agent has a greater resistivity than said second developing agent.

2. An electrostatic image forming apparatus according to claim 1, wherein:

the absolute value of a potential difference between the high electric potential and the intermediate electric potential is set to be smaller than the absolute value of a potential difference between the intermediate electric potential and the low electric potential.

3. An electrostatic image forming apparatus comprising:

a latent image forming means for forming an electrostatic latent image on a photoreceptor by a combination of a high electric potential, and intermediate electric potential and a low electric potential;

a first developing means which uses a first development bias electric potential provided between the high and intermediate electric potentials for developing an electrostatic latent image portion of the high electric potential by normal development; and a second developing means which uses a second development bias electric potential provided between said intermediate and low electric potentials for developing an electrostatic latent image portion of said low electric potential by reversal development;

wherein the absolute value of a potential difference between the first development bias electric potential and the intermediate electric potential is set to be smaller than the absolute value of a potential difference between the second development bias electric potential and the intermediate electric potential; and wherein the absolute value of a potential difference between the high electric potential and the intermediate electric potential is set to be smaller than the absolute value of a potential difference between the intermediate electric potential and the low electric potential.

* * * * *